US011393605B2

(12) United States Patent
Moricca et al.

(10) Patent No.: US 11,393,605 B2
(45) Date of Patent: Jul. 19, 2022

(54) RADIOACTIVE GRANULAR DISPENSING DEVICE

(71) Applicant: GeoRoc International, Inc., Chevy Chase, MD (US)

(72) Inventors: Salvatore Moricca, New South Wales (AU); Simon Chung, New South Wales (AU)

(73) Assignee: GEOROC INTERNATIONAL, INC., Chevy Chase, MD (US)

( * ) Notice: Subject to any disclaimer, the term of this patent is extended or adjusted under 35 U.S.C. 154(b) by 321 days.

(21) Appl. No.: 15/863,116

(22) Filed: Jan. 5, 2018

(65) Prior Publication Data

US 2018/0374595 A1 Dec. 27, 2018

Related U.S. Application Data

(60) Provisional application No. 62/443,265, filed on Jan. 6, 2017.

(51) Int. Cl.

| | |
|---|---|
| ***G21F 9/30*** | (2006.01) |
| ***G21F 9/36*** | (2006.01) |
| ***G21F 9/28*** | (2006.01) |
| ***G21F 9/34*** | (2006.01) |
| ***B65B 1/10*** | (2006.01) |
| ***B65B 1/28*** | (2006.01) |

(52) U.S. Cl.

CPC ..... *G21F 9/30* (2013.01); *B65B 1/10* (2013.01); *B65B 1/28* (2013.01); *G21F 9/28* (2013.01); *G21F 9/34* (2013.01); *G21F 9/36* (2013.01)

(58) Field of Classification Search

CPC ..... G21F 9/30; G21F 9/36; G21F 9/28; G21F 9/34; B65B 1/10; B65B 1/28; B65B 1/06; B65B 1/12

USPC ..... 251/210, 212, 208

See application file for complete search history.

(56) References Cited

U.S. PATENT DOCUMENTS 6,470,921 B1 * 10/2002 McGregor ..... B65B 1/12 141/12
6,726,174 B2 * 4/2004 Bareis ..... F02M 26/68 137/243
8,074,965 B2 * 12/2011 Carrato ..... F16K 1/308 251/144

(Continued)

FOREIGN PATENT DOCUMENTS

WO WO-2012164335 A1 * 12/2012 ..... B09B 3/0025

*Primary Examiner* — Mary E McManmon
*Assistant Examiner* — Andrew J Rost
(74) *Attorney, Agent, or Firm* — Finnegan, Henderson, Farabow, Garrett & Dunner, LLP

(57) ABSTRACT

There is disclosed a system for dispensing granular material, comprising: a nozzle attached to a granular filler configured to couple with a trefoil filling port attached to a can for hot isostatic pressing, wherein the nozzle opens and closes via a rotary actuation. In an embodiment, the system comprises a single fill port design, such as one having a concentric, tube-in-tube design. There is also disclosed a method of filling a container with a granular material, by connecting a filling nozzle to a filling port, opening/closing the filling nozzle, attaching the filling nozzle to the filling port, aligning at least one opening of the filling nozzle with an opening in the filling port; and dispensing granular material into the container.

18 Claims, 14 Drawing Sheets

(56) References Cited

U.S. PATENT DOCUMENTS

| | | | | |
|---|---|---|---|---|
| 8,201,819 | B2 * | 6/2012 | Asari | B65H 3/124 251/208 |
| 8,662,338 | B2 * | 3/2014 | Moricca | G21F 5/00 220/371 |
| 9,741,459 | B2 * | 8/2017 | Moricca | G21F 5/015 |
| 2014/0221720 | A1 * | 8/2014 | Moricca | G21F 9/36 588/11 |

* cited by examiner

RADIOACTIVE GRANULAR DISPENSING DEVICE

This application claims the benefit of priority to U.S. Provisional Application No. 62/443,265, filed Jan. 6, 2017, which is incorporated herein by reference in its entirety.

TECHNICAL FIELD

The disclosed embodiments generally relate to a device to fill radioactive powder into a HIP can that may be hot isostatically pressed in a controllable and safe manner. There is also disclosed a method to fill a HIP can with radioactive powder using the disclosed device embodiments.

Several concepts of filling system have been developed in the past to fill radioactive powder into fixed volume containers. This includes vitrification of calcined high-level liquid waste ("HLLW") as a glass within a metal storage canister. An exemplary prior art device is schematically shown in FIG. 1.

Vacuum powder compaction has been used in applications in which dusting or contamination is not critical. For example, as described by T. Akiyama et al. densification of powders by means of air, vibratory and mechanical compactions. See Powder Technology, Volume 46, Issue 2, 1986, Pages 173-180.

The prior art suffers from numerous technical limitations and problems. The major technical problems with the prior art is the inability to provide a physical barrier to prevent the spread of contamination caused by dusting during the disconnection of the filling nozzle after filling. Prior art designs stop the flow of granular from the filling nozzle, but there is no physical barrier to stop dust from escaping from the container.

"Dry break" designs are seen in other applications, such as "DryLink" and split butterfly valve for containing products while disconnecting. However, these designs require the use of polymeric materials for sealing, which are not compatible for heat, pressure and radiation environment that the process is subjected to. They are also prohibitively expensive for one-off applications (not reusable after HIP) and relatively bulky for HIP canisters.

Another problem with the prior art is the linear actuated valves (e.g. bell and cone valves), which have alignment issues. The size of the particle that can be handled is limited by the clearance of the opening. It is also unable to cut the flow of granular and disconnect safely if the container is accidentally overfilled.

SUMMARY

Aspects of the present application overcome the drawbacks and limitations of the prior art, although other improvements not recognized the prior art are also disclosed. Applicants have developed a system that minimizes contamination that may be caused by dusting during connection and disconnection of a filling nozzle. In one embodiment, there is disclosed a system for dispensing granular material, such as radioactive powder. In another embodiment, the system for dispensing granular material into a container that is to be hot isostatically pressed, includes, a nozzle comprising at least one opening that opens and closes through a rotary actuation, the nozzle being configured to attach to a filling port that is integrally connected to the container that is to be hot isostatic pressed. In another embodiment, the at least one opening of the nozzle may be aligned with an opening in the filling port prior to any granular being dispensed into the container.

There is also disclosed a method of filling a HIP can with a granular material, such as powdered waste materials, including radioactive materials, using the various embodiments described herein. For example, there is described a method of filling a HIP can with a powdered material, the method comprising connecting a nozzle to a filling port that is integrally connected to a HIP can, wherein the nozzle comprises at least one opening that opens and closes through a rotary actuation. In the described method, the nozzle is configured to attach to the filling port such that at least one opening of the nozzle is aligned with an opening in the filling port prior to any granular being dispensed into the container.

Exemplary embodiments are directed to a system for dispensing granular material into a container configured to be hot isostatically pressed, the system may include a filling nozzle having at least one opening. The filling nozzle may be configured to open and close via rotary actuation, or other types of actuation. The system may include a filing port that is integrally connected to the container. The filling nozzle and filling port may be configured to selectively attach together. The filling nozzle may be configured to conditionally allow the granular material to be dispensed into the container when an opening of the filling nozzle is aligned with an opening in the filling port. In some embodiments, a single filling port may be located on an end of the container. For example, the container further comprises a lid, the lid having a symmetrical design configured to enable centralized filling via the single filling port.

In exemplary embodiments, the filling nozzle and the filling port may have a concentric, tube-in-tube design. For example, the tube design includes an internal tube that is configured to allow filling of granular material and a concentric external tube that is configured to allow safe evacuation of materials from within the container. The filling port may further include a valve 350 (FIGS. 6B and 7B) that is configured to provide an evacuation path that safely mitigates dust contamination from occurring due to the nature of the granular material under flow. In one embodiment, the system described herein further comprises a lid, the lid having a symmetrical design configured to enable centralized filling via the single filling port.

Exemplary embodiments may also include one or more safety locking mechanisms configured to conditionally allow a filling process to begin when the filling nozzle and container are securely fastened together. For example, one or more safety locking mechanisms may include a push-open or rotary-open coupling mechanism that is configured to ensure the valve(s) are open only when the filling nozzle and container are intimately engaged. Thereby safety is ensured. Other embodiments may include the addition safety element of a spring-loaded mechanism configured to rest hi a closed position that prevents the free flow of material.

Other embodiments may include at least one vacuum that is attached to an end thereof, the vacuum may be configured to allow the simultaneous filling of radioactive powders and evacuation of the HIP canister. A vibratory device or vacuum powder compaction device may also be included. The device may be configured to pack the granular material and thereby increase its density and/or reduce particulate void space. Embodiments in accordance with the present disclosure may further include one or more sintered filters 375 that is in line with the evacuation pathway. The sintered filters 375 may prevent dust carryover.

In exemplary embodiments the filling nozzle is a remote interchangeable filling nozzle that enables remote maintenance of the container and access to an inside area of a hot cell. The filling nozzle may include at least one in-line rotary valve configured to control a mass flow of granular material. Each respective one of the at least one in-line rotary valves includes faces made of ceramic with polished surfaces, thereby ensuring leak tight sealing and the prevention of damaging abrasion of the faces.

Some embodiments may include a pre-fill hopper connected to the nozzle to prevent overfilling of the container. Exemplary embodiments may also include load cells and weighing balances to weigh and monitor the pre-fill hopper and the container. In some embodiments the at least one opening may be of a tre-foil type configuration in which the rotary actuation opens by rotating about 60 degrees. The openings may be configured to align with an opening of the filling port via set pins, the set pins projecting from the filling nozzle and being restrainedly circumscribed by openings on the filling port when engaged therewith.

DETAILED DESCRIPTION OF THE DRAWINGS

FIG. 6 is a filling nozzle according to the present disclosure in an opened position.

FIG. 98 is a cross-section of FIG. 9A.

It is to be understood that both the foregoing general description and the following detailed description are exemplary and explanatory only and are not restrictive of the invention, as claimed.

DETAILED DESCRIPTION OF THE INVENTION

Applicants herein disclose a system that minimizes contamination caused by dusting during connection and disconnection of a filling nozzle. In one embodiment, there is disclosed a system for dispensing granular material, such as radioactive powder. As used herein, "granular" material is intended to mean a dry, bulk solid composed of particles that may flow freely. Granular is intended to include powders, which, like granular materials, comprise dry, bulk solid particles, which include more fine particles than course particles. Thus, as used herein, "granular" material is meant to encompass both course material and fine powders, and combinations thereof.

In another embodiment, the system for dispensing powder material into a container that is to be hot isostatically pressed, comprises: a nozzle comprising at least one opening that opens and closes through a rotary actuation, the nozzle being configured to attach to a filling port that is integrally connected to the container that is to be hot isostatic pressed. As described in more detail below, the at least one opening of the nozzle is aligned with an opening in the filling port prior to any powder being dispensed into the container.

In one embodiment, there is described a tre-foil filling nozzle that is designed to couple with a tre-foil filling port design. Applicants have discovered that this design eliminates the dust containment issues of the prior art, among other benefits.

In another embodiment, the filling nozzle and filling port comprises a large cross-sectional area opening for the flow of powder for handling larger particles and the prevention of blockages.

In another embodiment, the multi-foil design operates via a rotary actuation (rotary actuator) which solves alignment issues associated with alternative linear actuated bell and cone valves. It is supported at both ends of a drive shaft unlike the cone valve which is supported only at one end and requires it to be either pushed or pulled in the axial direction to initiate flow past it. The multi-foil design discloses herein only needs to rotate to align the openings leading from the product supply to the HIP can fill area. In addition, through simple rotary action the multi-foil design can cut through the flowing powder to shut off flow.

Figure 2:
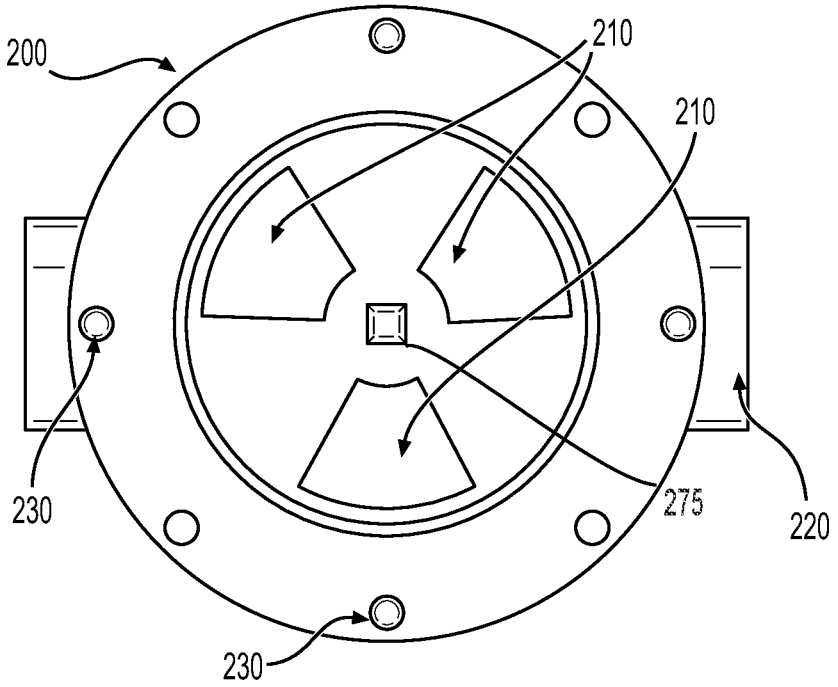
FIG. 2 is an end view of a filling nozzle showing tre-foil design according to the present disclosure.
Figure 3:
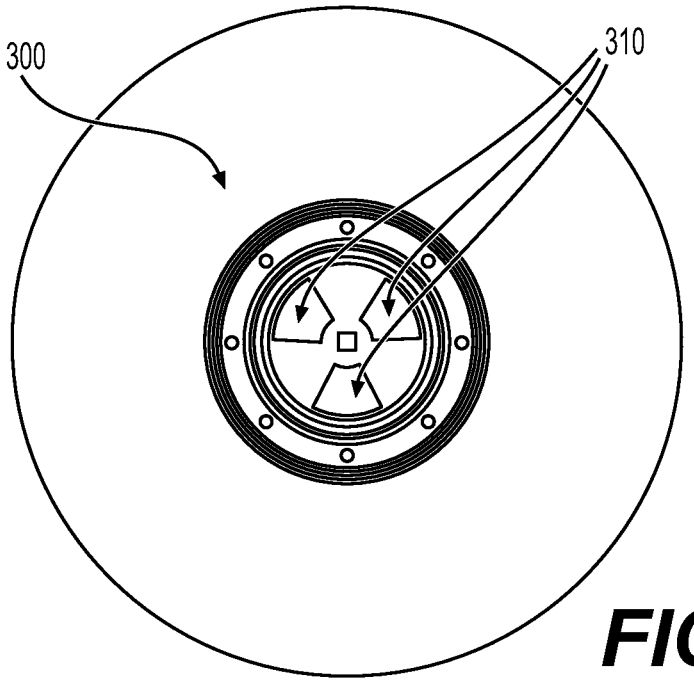
FIG. 3 is an end view of a filling port showing tre-foil filling nozzle design 300 according to the present disclosure.

With reference to FIG. 2, there is described a filling nozzle 200 having a multi-opening design, here showing tre-foil design 210 according to the present disclosure. In this embodiment, the filling nozzle shown in FIG. 2 is supported at both ends of a drive shaft 220. In practice, the filling nozzle 200 is aligned with the filling port, such as the port shown in FIG. 3. In this embodiment, the tre-foil openings of the filling nozzle 210 are aligned with tre-foil openings of the filling port 310. Alignment can be assured by using set pins 230.

Figure 1:
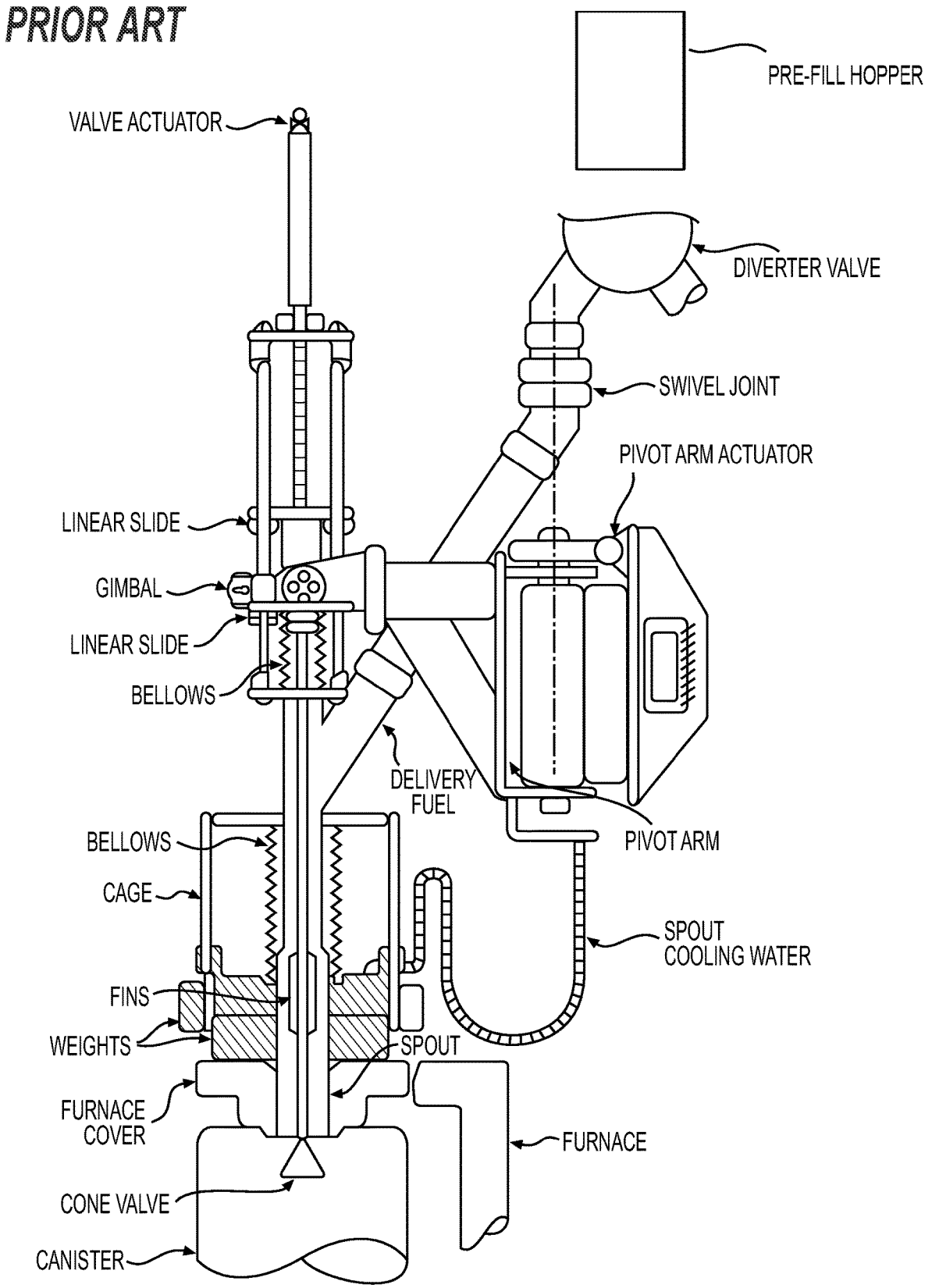
FIG. 1 is a schematic of a prior art super-calcine delivery system having a cone valve design.
Figure 4:
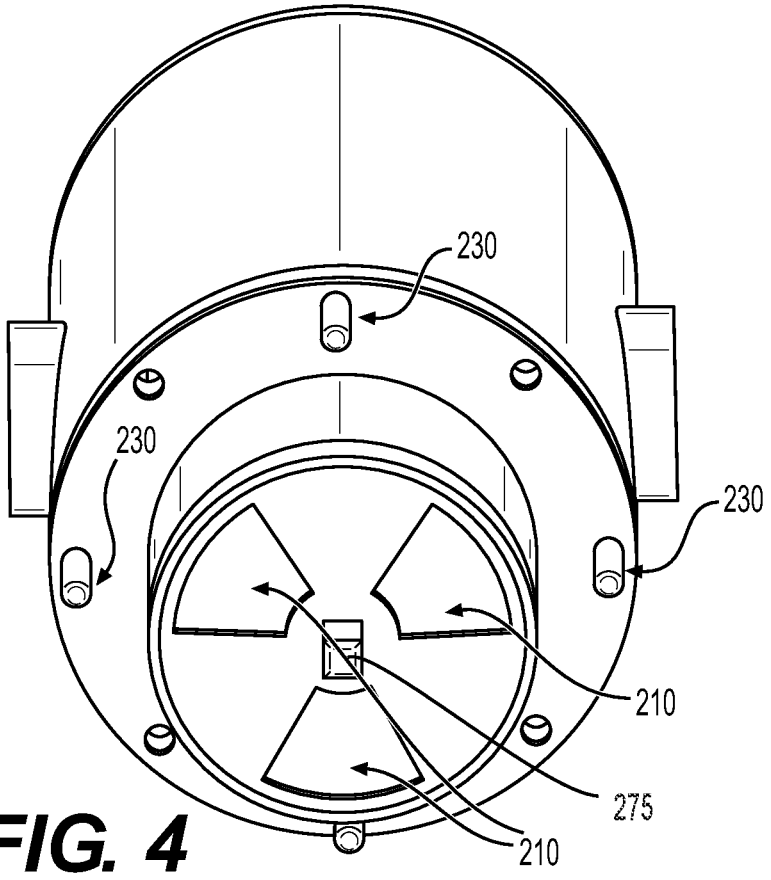
FIG. 4 is a filling nozzle according to the present disclosure in a closed position.
Figure 5:
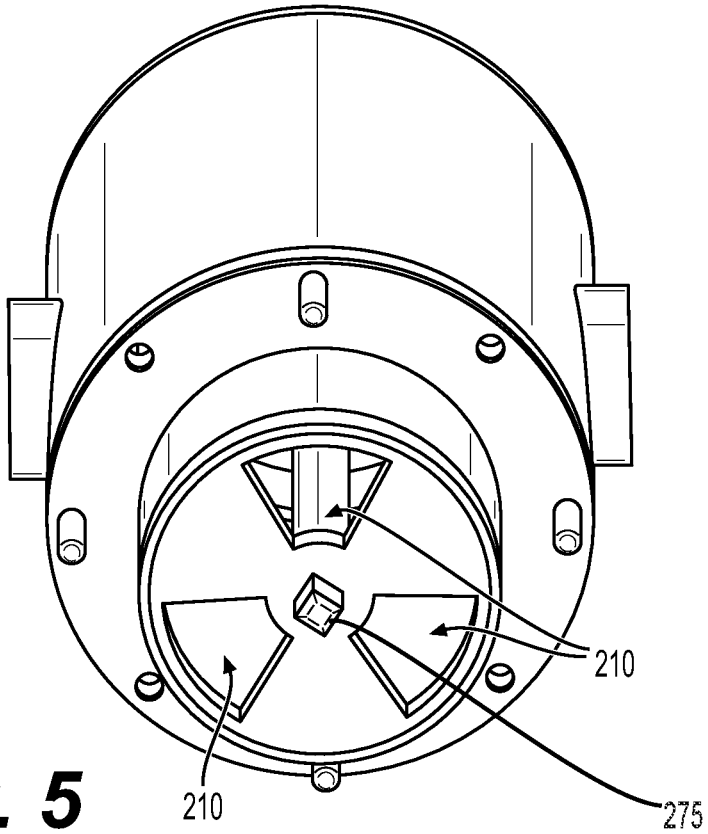

With further reference to the figures, FIG. 4 shows the filling nozzle according to FIG. 1, with the tre-foils 210 in a closed position. FIG. 5 is a filling nozzle according to FIG. 1, with the tre-foils 210 in an opened position.

In one embodiment, the described filling nozzle can be used with or without a radial alignment pin(s). For example, with a radial alignment pin installed, it is possible to restrict the rotation of the dynamic disc. For example, in one embodiment that is shown in FIGS. 2-5, with zero degree (0°) is close position and sixty degrees (60°) is the open position.

In another embodiment, when using the described filling nozzle without a radial alignment pin, there is a freedom to spin the dynamic discs, e.g., the filling nozzle and port. This embodiment is capable of removing residue powder. In this embodiment, linear and/or rotary actuators may control an angular position of the valve.

Depending on the operating conditions (e.g. glovebox vs hot cell), the filling nozzle can be actuated by one or more actuators that may be pneumatic or electric, linear or rotary.

In at least one embodiment, the dynamic discs r nay be spring loaded (both filling nozzle and port) to ensure good sealing between the dynamic and static discs.

In at least one embodiment there is described a single port design. This embodiment comprises a filling nozzle (on powder filler) and filling port 300 (on HIP can) having a tube-in-tube design. In this embodiment, the internal tube is used for filling powder while the concentric external tube is for evacuation purposes. This allows evacuation of the HIP can volume before, during, and after a filling process. This feature greatly improves the safety and efficiency over a single port design.

The Inventors have discovered that positive pressure from behind the powder column will assist the powder to flow. For example, in embodiments disclosed herein, it is possible (but not required) to introduce compressed gas into the filling nozzle, while evacuating materials from the HIP canister. In this embodiment, the flow of gas as well as the flow of powder into the HIP canister may be enhanced by the use of compressed gas. This is especially true for fine powders that are typically difficult to flow.

In another embodiment, the introduction of compressed gas to enhance the flow of powder can be further enhanced with the introduction of heat, in other words, hot compressed gas can be used for direct heating of powder. This embodiment of hot filling may increase process efficiency. In one embodiment, the powder is calcined prior to flowing into the fill port.

Figure 6B:
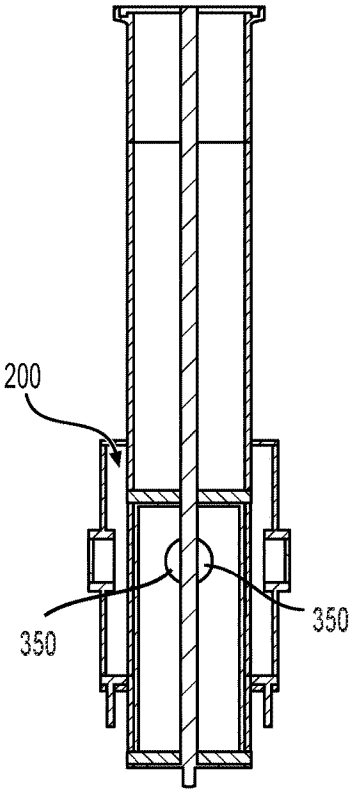
FIG. 6B is a cross section of FIG. 6A.
Figure 6B:
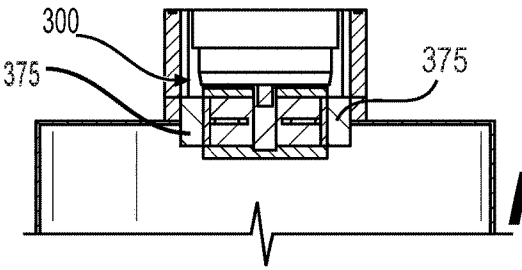
Figure 6A:
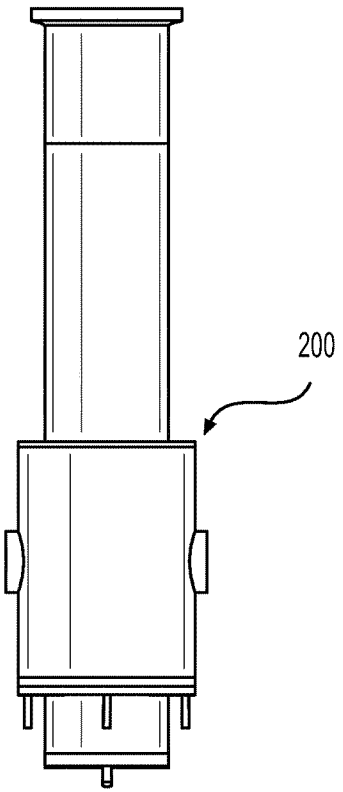
FIG. 6A is a perspective of the first step or start position of a method according to the present disclosure.
Figure 6A:
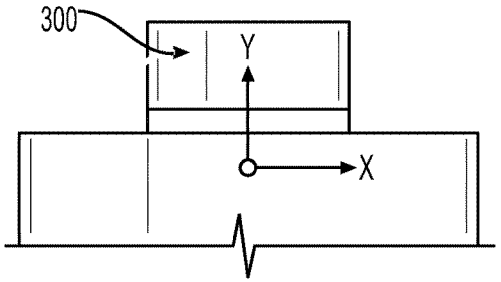
Figure 7B:
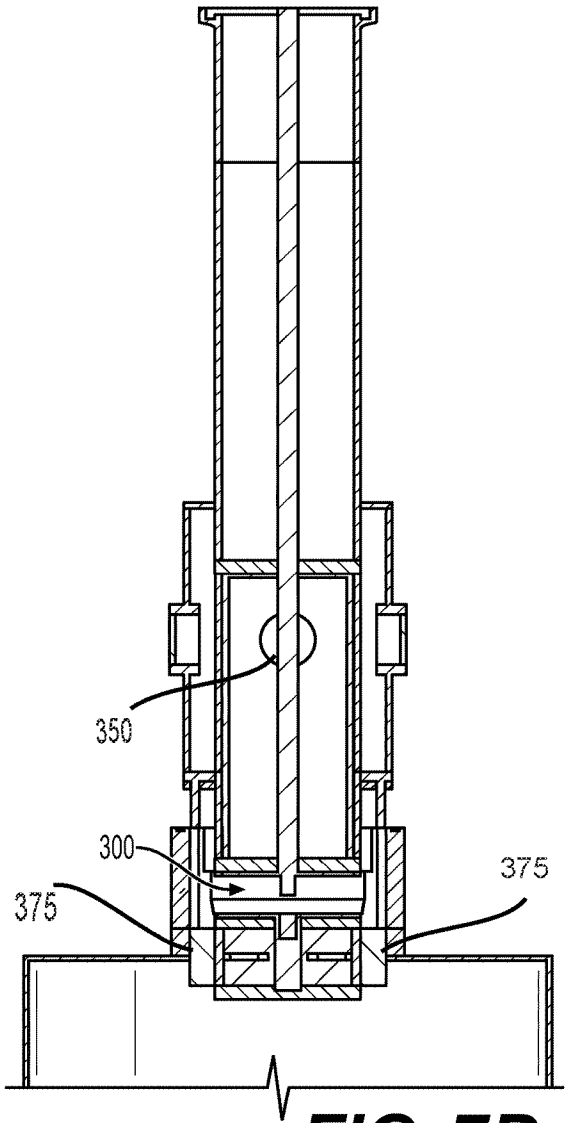
FIG. 7B is FIG. 7A in cross-section.
Figure 7A:
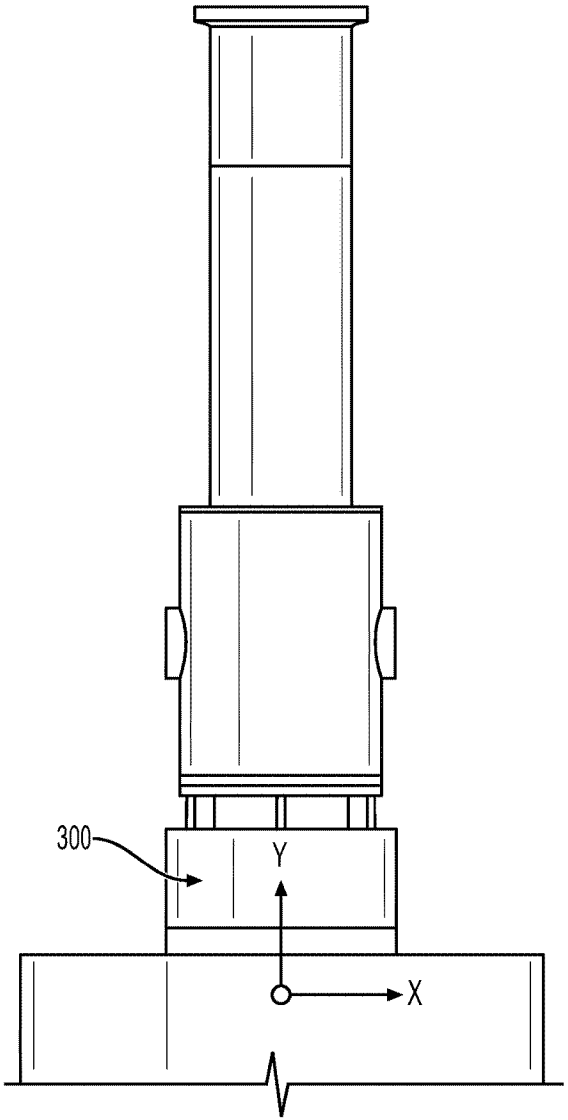
FIG. 7A is a perspective of an alignment step of a method according to the present disclosure.
Figure 8B:
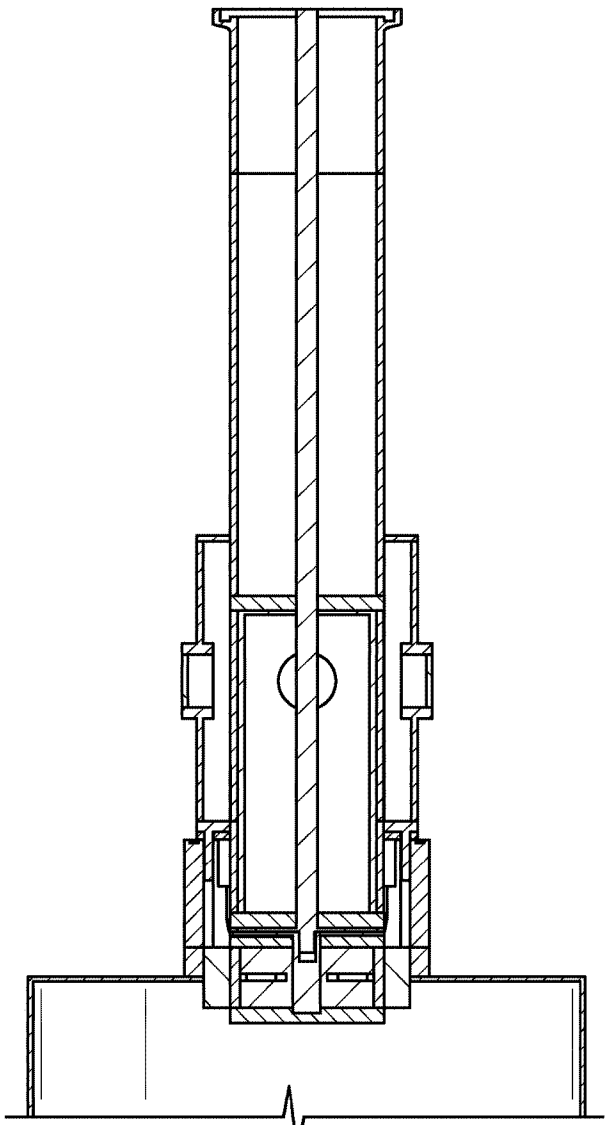
FIG. 8B is a cross-section of FIG. 8A.
Figure 8A:
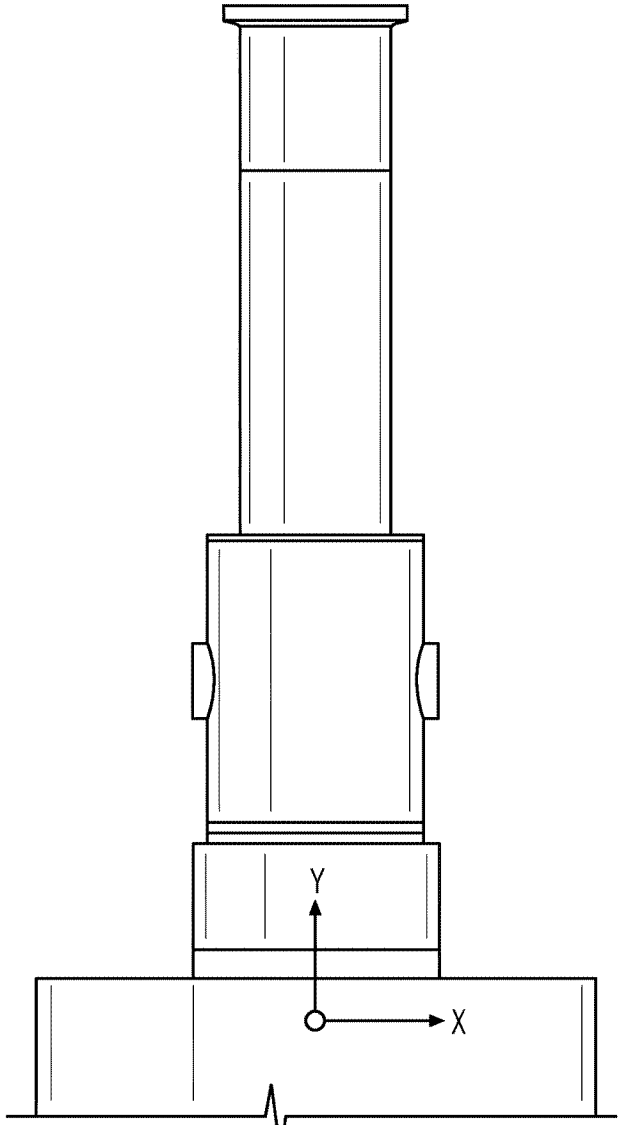
FIG. 8A is a perspective of a filling nozzle connected via a method according to the present disclosure.
Figure 9B:
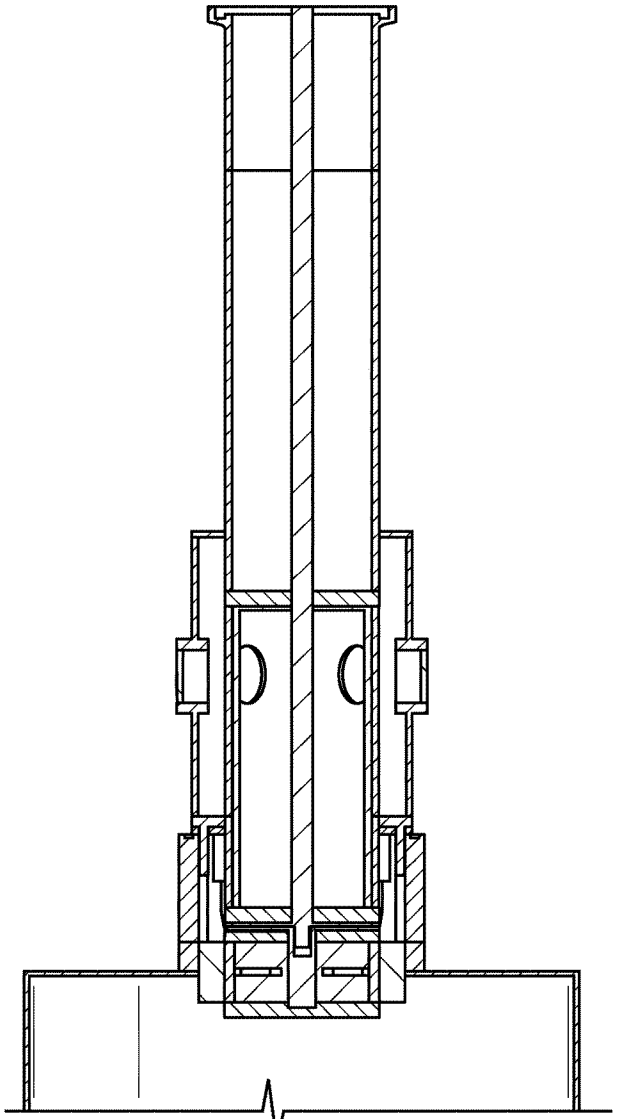
FIG. 9A is a perspective of the filling nozzle engaged and locked with the filling port, and a valve being opened according to a method disclosed herein.
Figure 9A:
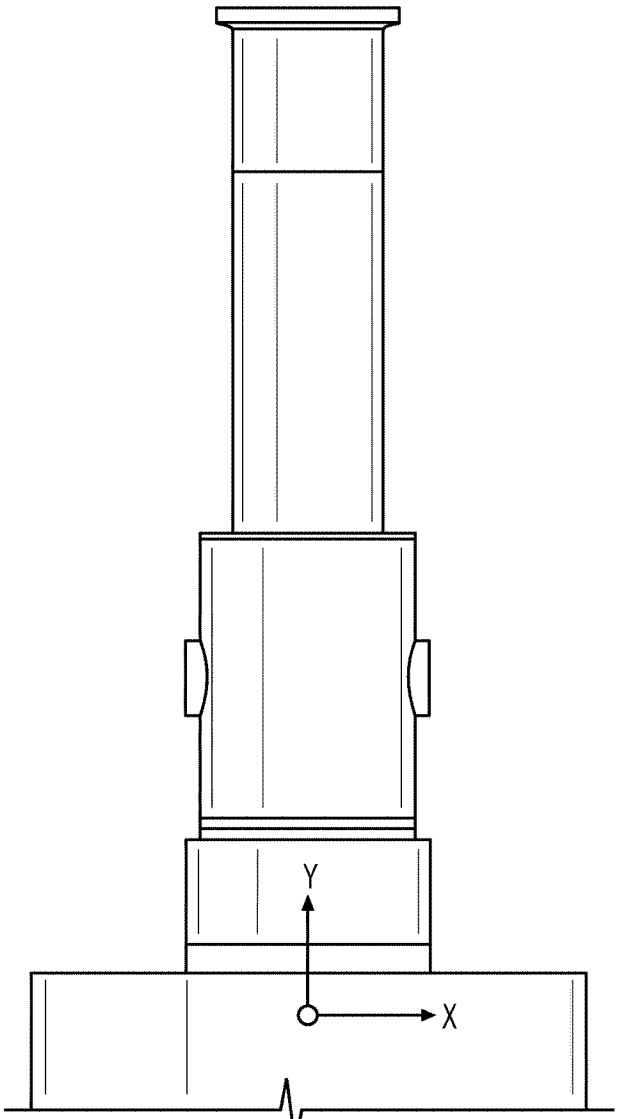
Figure 10B:
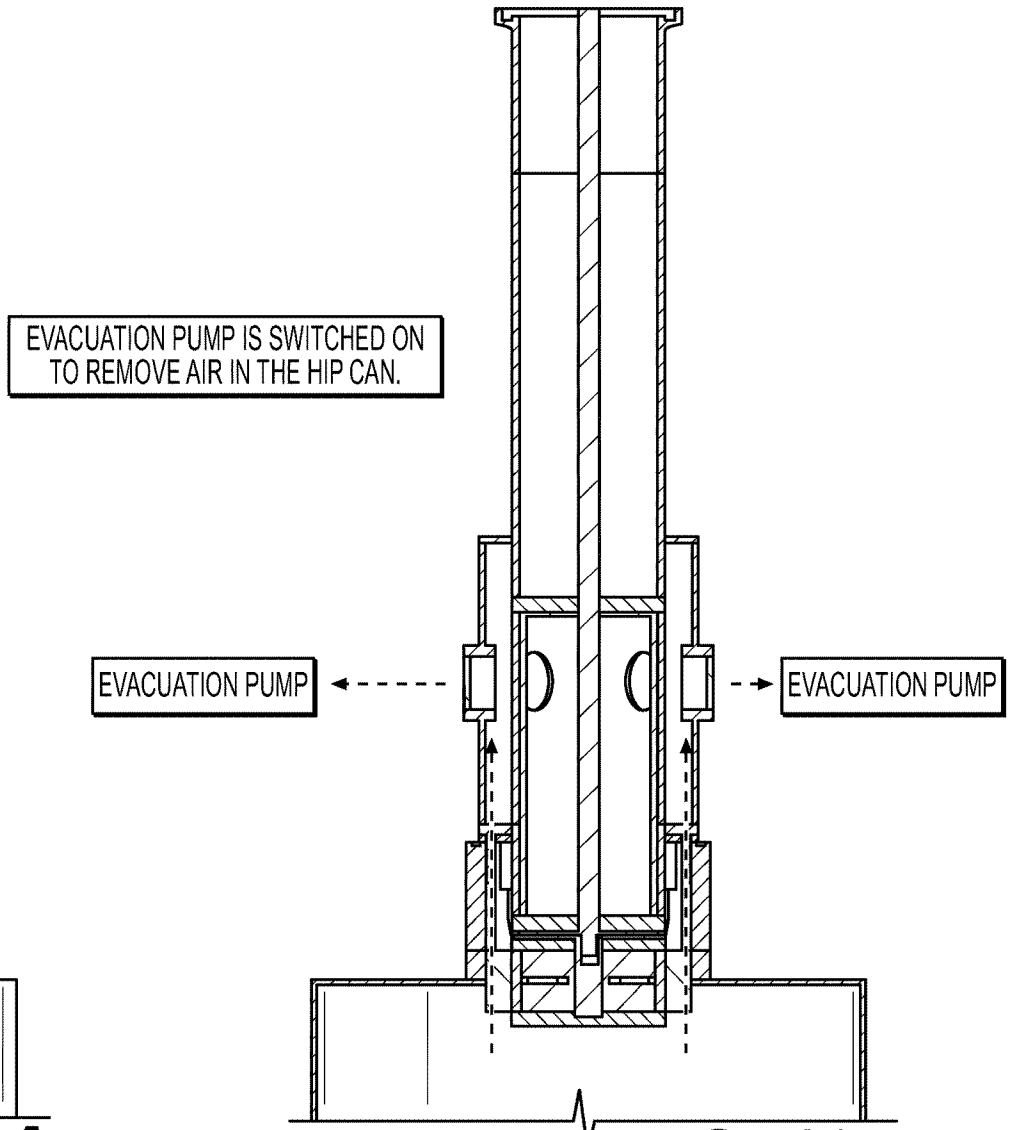
FIG. 10B is a cross-section of FIG. 10A.
Figure 10A:
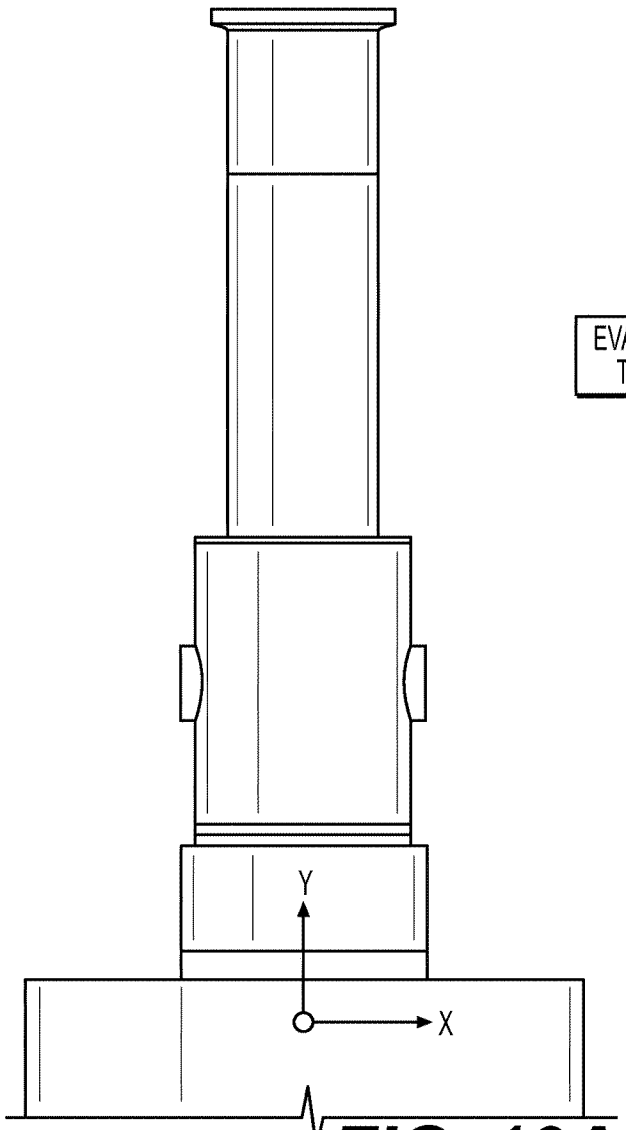
FIG. 10A is a perspective showing the can being evacuated according to a method disclosed herein.
Figure 11B:
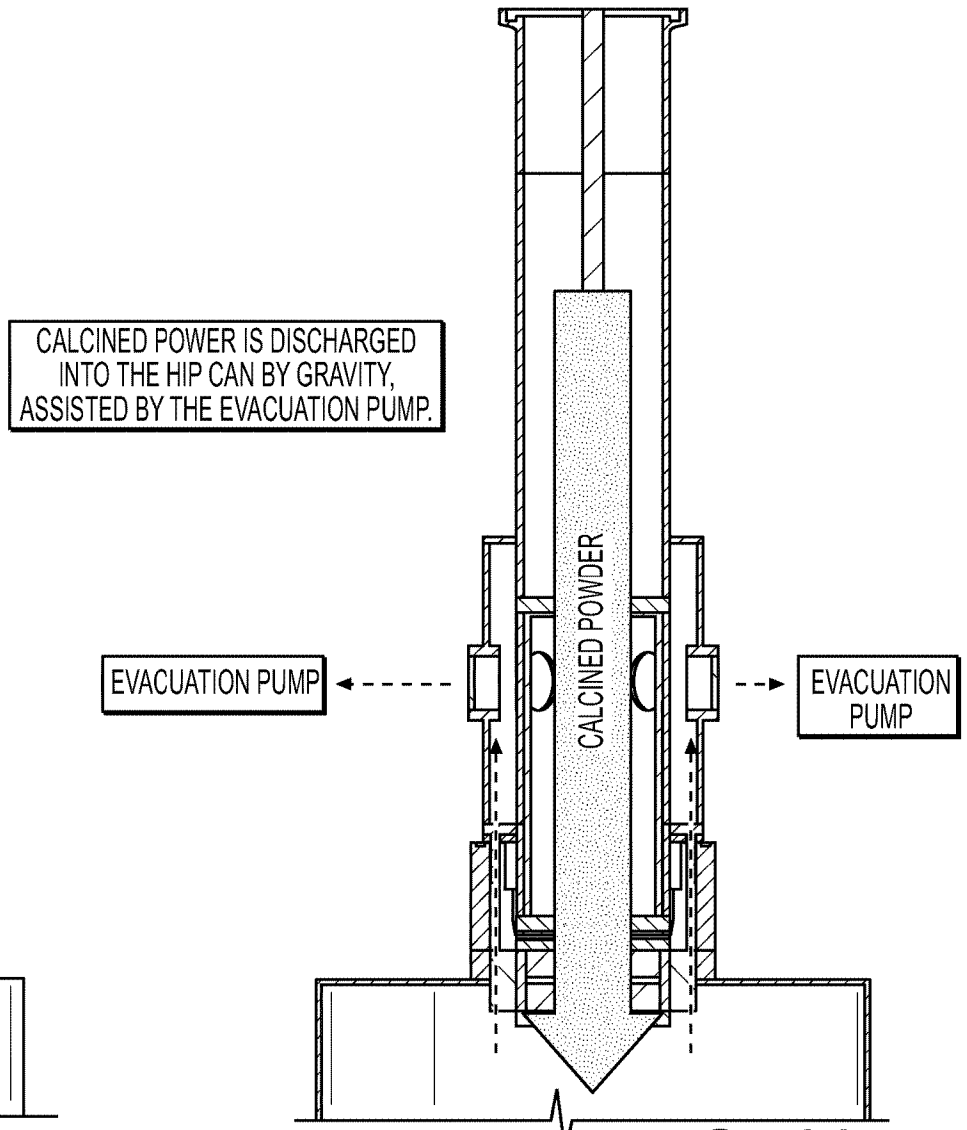
FIG. 11B is a cross-section of FIG. 11A.
Figure 11A:
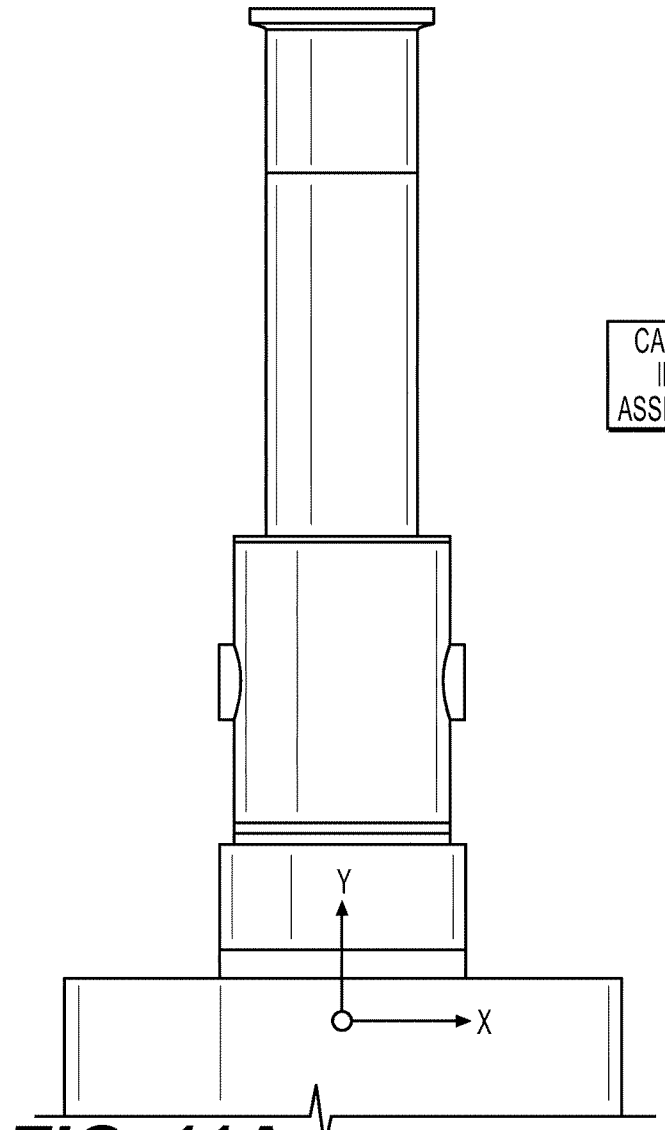
FIG. 11A is a perspective showing the can being filled with granular according to a method disclosed herein.
Figure 12B:
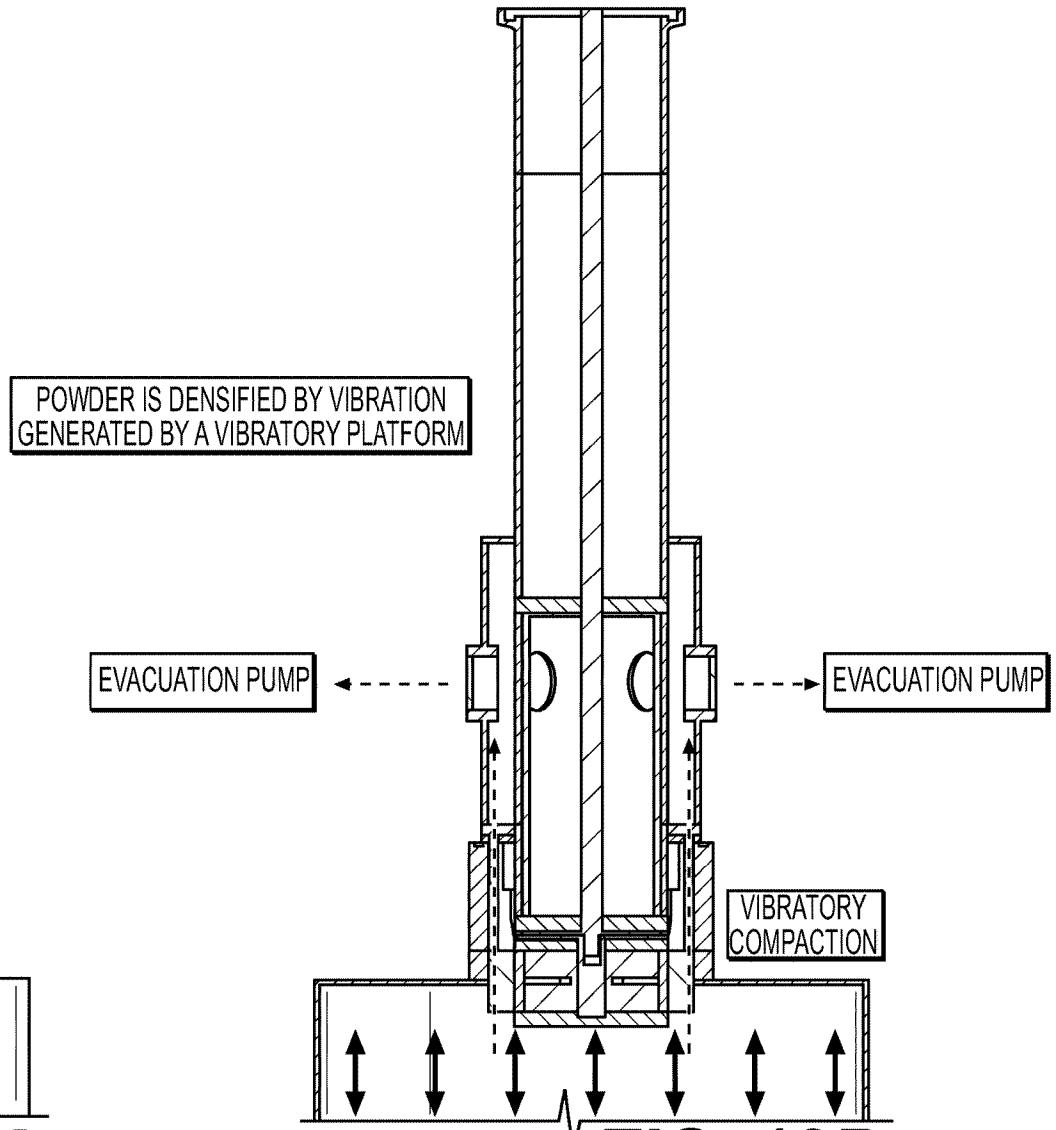
FIG. 12B is a cross section of FIG. 12A.
Figure 12A:
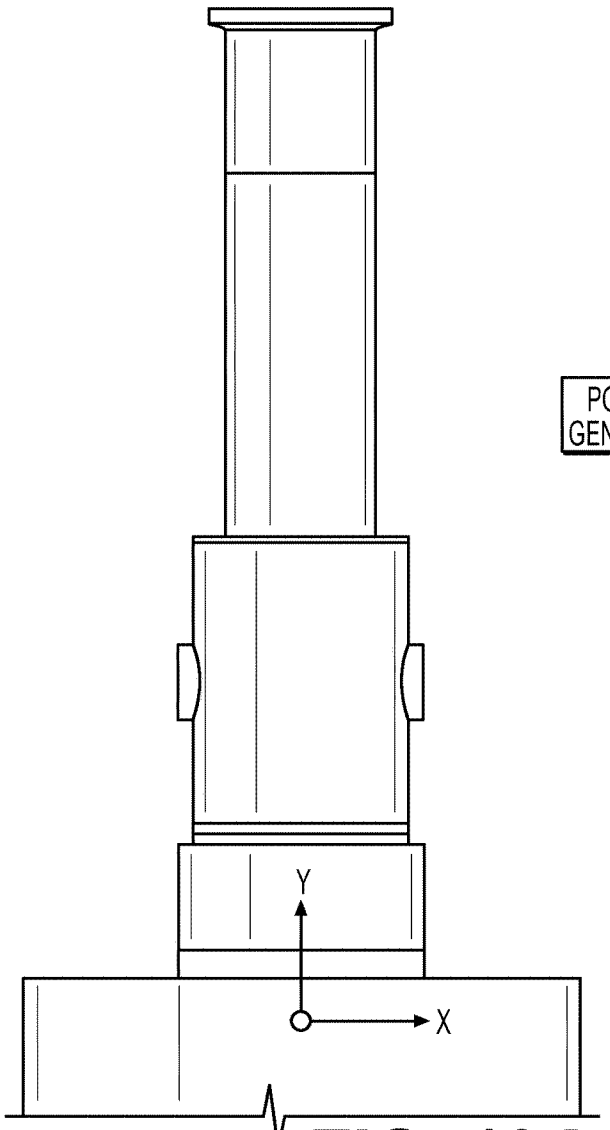
FIG. 12A is a perspective showing the can undergoing vibratory compaction according to a method disclosed herein.
Figure 13B:
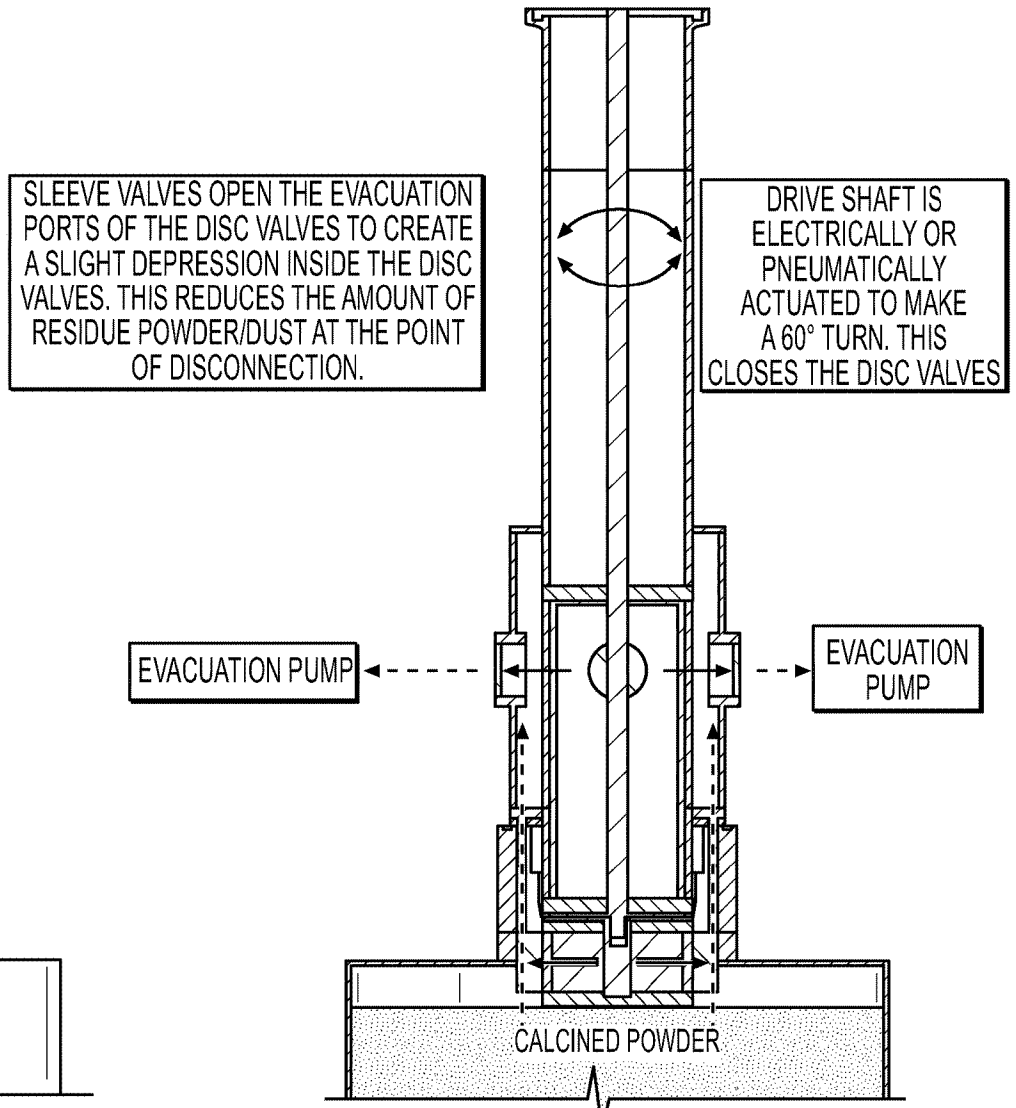
FIG. 13B is a cross-section of FIG. 13A.
Figure 13A:
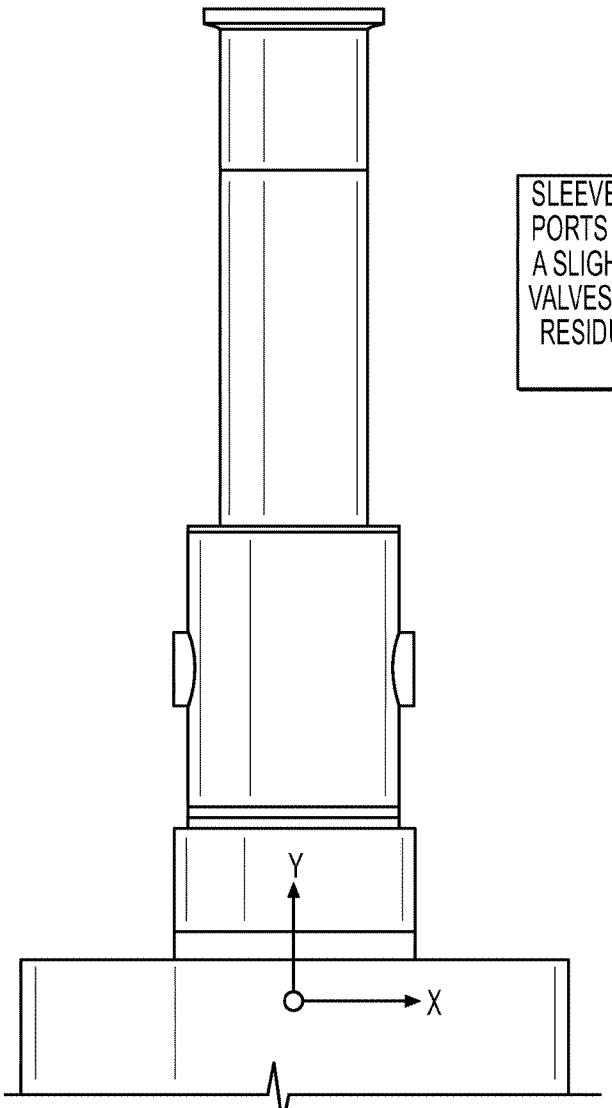
FIG. 13A is a perspective showing the valve closed after filling the can according to a method disclosed herein.
Figure 14B:
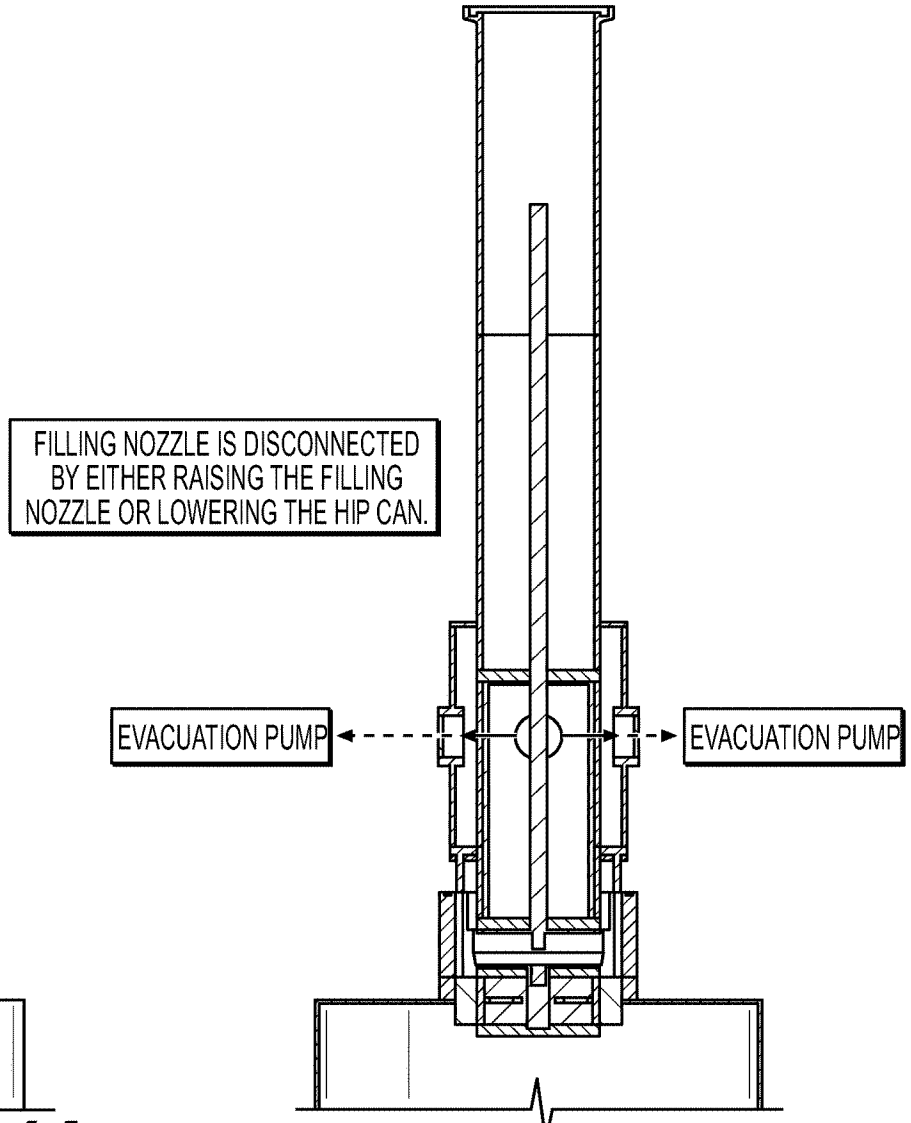
FIG. 14B is a cross-section of FIG. 14A.
Figure 14A:
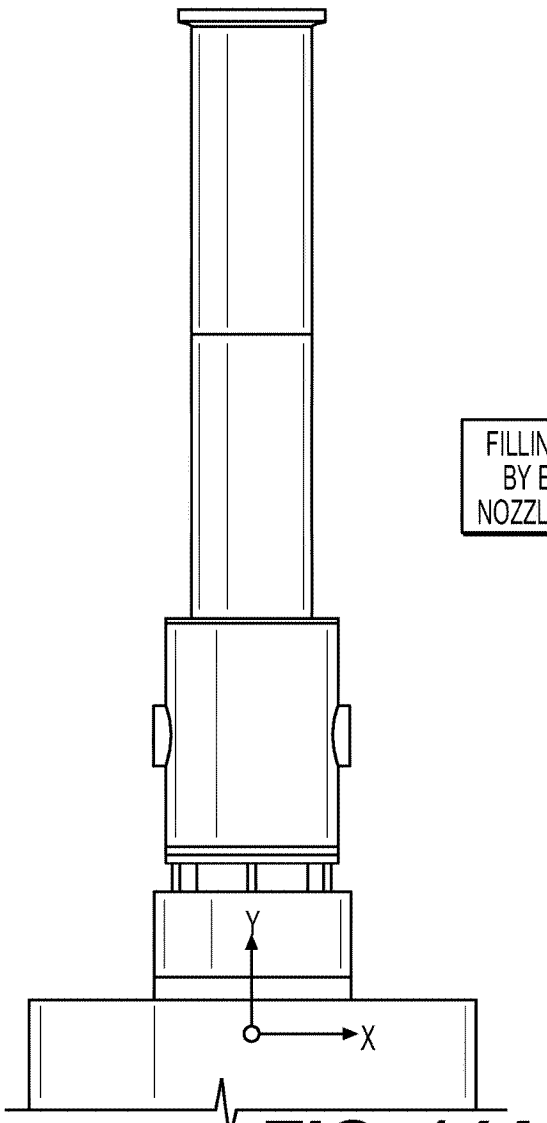
FIG. 14A is a perspective of the filling nozzle disconnected by a method according to the present disclosure.
Figure 15B:
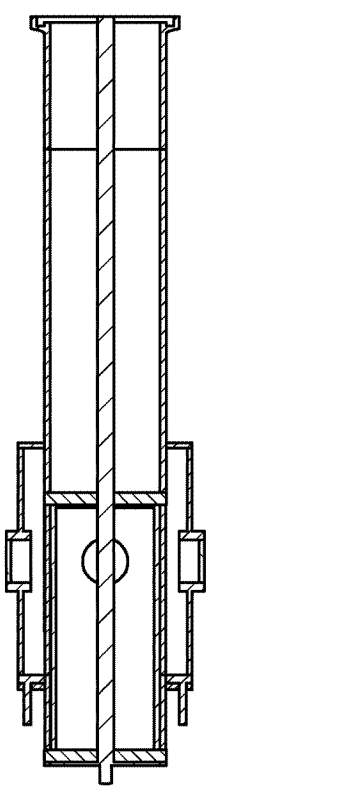
FIG. 15B is a cross-section of FIG. 15A.
Figure 15B:
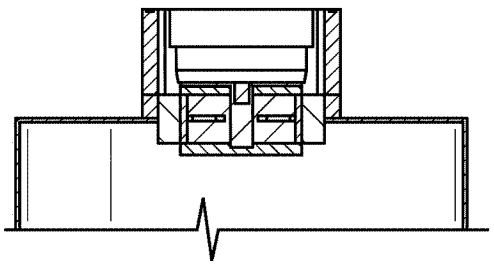
Figure 15A:
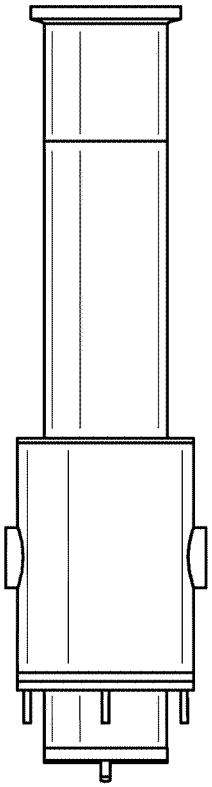
FIG. 15A is a perspective of the completed filling process in a method according to the present disclosure.
Figure 15A:
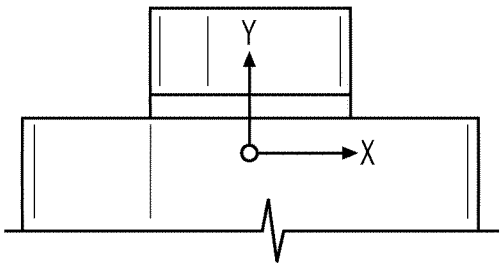

In the single port design, after filling of the can and during disconnecting of the filling tube from the HIP can fill port 300, a valve 350 (FIGS. 6B and 7B) inside the filling port opens an evacuation path to remove any residue dust at the disconnecting point for dust containment.

In contrast to a double port design (one for filling, one for evacuation), a single port design for evacuation and filling means a symmetrical CAN and lid design. This may allow powder to fill the can in a more evenly distributed way as opposed to off center filling which leads to uneven filling of the HIP can. Off center filing can lead to distortion of the HIP can and/or collapse during processing. Additionally, a centralized filling port is better for automated orbital welding procedures and lifting/moving. Furthermore, a size of port may be increased to nearly the diameter of HIP can top plate and all sub-ranges in between.

In another embodiment, the device described herein includes a safety locking mechanism to ensure filling nozzle and HIP can safety. The filling nozzle and HIP can may be fastened together during a filling process.

In another embodiment, the device described herein includes push-open or rotary-open coupling (275) to ensure valves are opened only when the filling nozzle and HIP can are intimately engaged, thereby removing any gap between the faces. This type of coupling (275) ensures that on separating both the HIP can side and the filling nozzle side the internal areas of both are shut off from the external environment. In another embodiment, the described system comprises an interlocking mechanism (275) designed such that a filling nozzle can only be opened when it is connected to a filling port, thereby adding additional safety and certainty. In another embodiment, the filling port on the HIP can comprises a spring-loaded mechanism (275) that may ensure it is in normally-closed position i.e., the closed position is the resting condition of the mechanism. At least one advantage of this type of design is that it may prevent accidentally opening the filling port with radioactive powder inside of the HIP can.

In another embodiment, the filling nozzle coupling valve can be rotated greater than 360 degree forward and in reverse. An advantage of this type of design is that it may allow more effective cleaning of particulates, and reduce clinging on the internal surfaces of the valve. A position of the valve may be precisely controlled to regulate the opening of the valve.

The foregoing locking and coupling mechanisms may eliminate, or greatly mitigate, the probability radioactive materials are released, which in turn prevents contamination issues of the external environment, e.g. hot cell or glove-box containment.

In one embodiment, locating pins having a tapered geometry may be included with the filling nozzle. The locating pins may allow precisely aligned engagement to the filling port.

There is also disclosed a method of filling a HIP can with a powdered material, such as powdered waste materials, including radioactive materials, using embodiments and various systems described herein. For example, there is described a method of filling a HIP can with a powdered material, the method comprising connecting a nozzle to a filling port that is integrally connected to a HIP can, wherein the nozzle comprises at least one opening that opens and closes through a rotary actuation. In the described method, the nozzle is configured to attach to the filling port such that at least one opening of the nozzle is aligned with an opening in the filling port prior to any powder being dispensed into the container.

The method described herein allows for a powdered material to fill an HIP can through a single fill port. The single fill port may be located in the lid of the HIP can. In the disclosed system utilized by the disclosed method, the HIP can comprises a lid having a symmetrical design that allows for centralized filling of a port.

In another embodiment, the method allows for filling of the HIP can with powder using the same tube that evacuates the HIP can. For example, in this embodiment, the filling nozzle and filling port have a concentric, tube-in-tube design such that powdered materials may be provided to the HIP can through the internal tube. Next, a vacuum (flow) may be pulled through the concentric external tube to evacuate the HIP can volume. This method allows for a single nozzle to be used when handling dangerous powdered materials, such as powdered materials that are radioactive or toxic.

Figure 16:
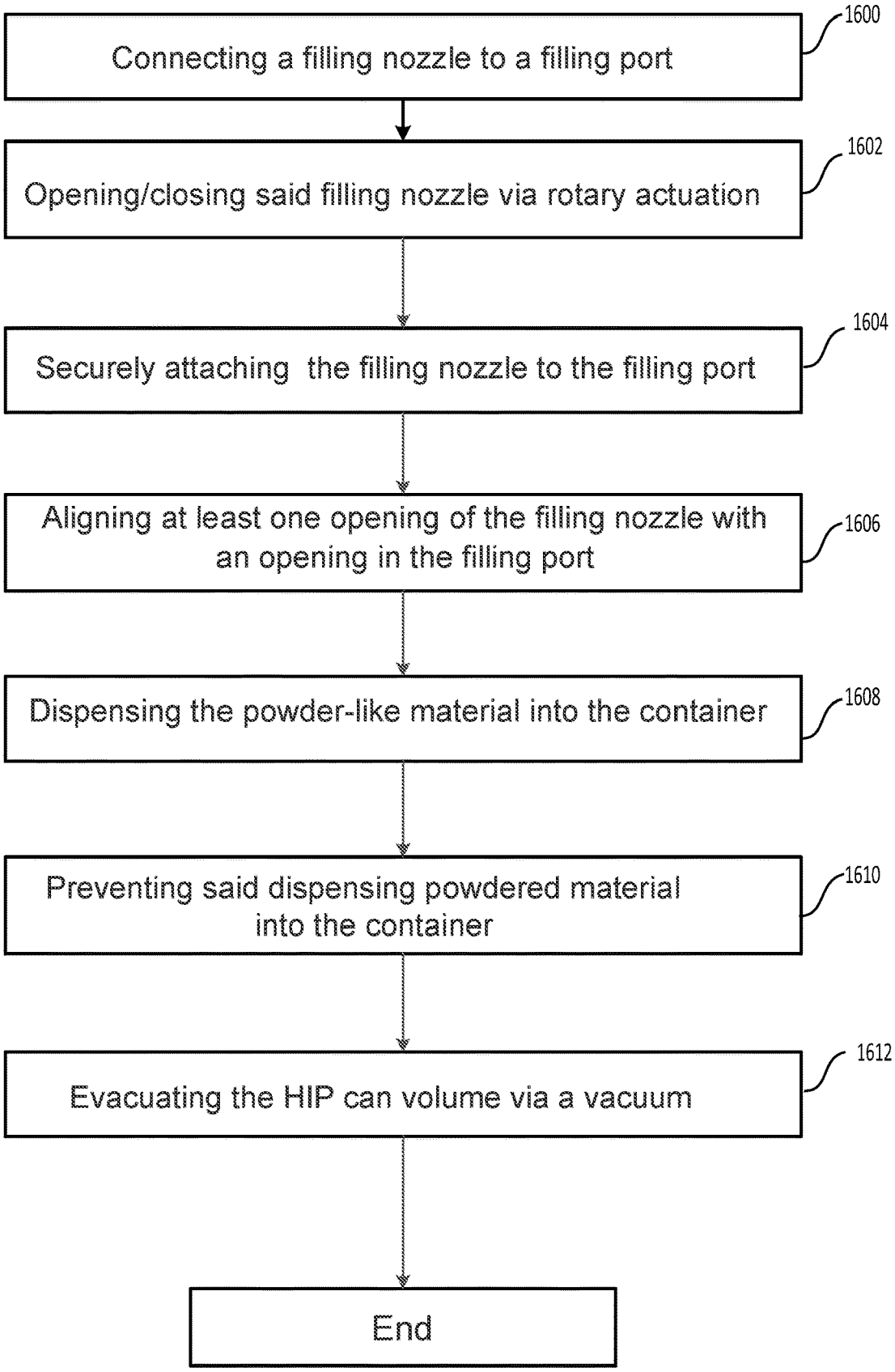
FIG. 16 is an exemplary method in accordance with the disclosure.

FIG. 16 is an exemplary diagram of a method in accordance with the present disclosure. The method may include the steps of connecting a filling nozzle to a filling port that is integrally connected to the HIP can 1600. Opening and closing the filling nozzle via rotary actuation 1602. Securely attaching the filling nozzle to the filling port 1604. Aligning at least one opening of the filling nozzle with an opening in the filling port 1606. Dispensing the granular material into the container 1608. Actively preventing and/or conditionally allowing the dispensing powdered material into the container prior to aligning the at least one opening of the filling nozzle with an opening in the filling port by configuring the filling port to disallow dispensing of powdered material until the aligning at least one opening of the filling nozzle with an opening in the filling port is safely completed 1610. Other exemplary methods may include providing the filling nozzle and filling port such that they have a concentric, tube-in-tube design, wherein the dispensing powdered material into the container is further performed such that granular material is provided to the HIP can through the internal tube of the concentric tube-in-tube design (not illustrated). Other exemplary methods may further include the step of evacuating the HIP can volume by puffing powdered material through the concentric external tube of the concentric tube-in-tube design via a vacuum 1612

As described herein the devices and methods described herein allow the filling of radioactive powders and evacuation of an HIP canister simultaneously. This can be furthered by vibratory or vacuum powder compaction to achieve a higher powder packing density for higher process efficiency. In such an embodiment, sintered filters may be used on the evacuation pathway to prevent dust carryover.

The systems described herein may include a variety of features that improve safety and reliability during normal operation. A non-limiting list of these features include:

- Remote interchangeable filling nozzle configured to allow remote maintenance inside a hot cell.
- Valve faces that can be made of ceramic with polished surfaces to ensure leak tight sealing and prevention of abrasion of the sealing faces.
- Sintered filters that can be cleaned by pulses of compressed air in reverse direction, which prevents blinding the sintered filters.
- Quick disconnect fittings for ease of maintenance.
- Shaft seals allowing the replacement of faulty actuators while containing radioactive dust particles.
- Telescopic motion of the filling nozzle/tube can be used to prevent dust generation.
- In line rotary valve that may control mass flow of powder.
- Pre-fill hopper to prevent overfilling.
- Weight of pre-fill hopper and the HIP can are monitored by load cells and weighing balances.
- Lifting mechanism to automate the filling nozzle and filling port engagement process.
- Position sensor (e.g. draw-wire displacement sensor) detects the position of the lifting platform.
- Vacuum pump to create preselected differential pressure before, during and after a filling process for flow assist and dust containment.
- Vibratory table with vibrations generated by vibratory motors for vibratory powder compaction to increase product packing density.

Other embodiments of the invention will be apparent to those skilled in the art from consideration of the specification and practice of the invention disclosed herein. It is intended that the specification and examples be considered as exemplary only, with the true scope of the invention being indicated by the following claims.

What is claimed is:

1. A method of filling a HIP can with a granular material, the method comprising:

connecting a filling nozzle having at least one opening to a filling port having at least one opening, wherein the filling port is integrally connected to the HIP can;

opening/closing the filling nozzle via rotary actuation;

securely attaching the filling nozzle to the filling port;

aligning at least one opening in the filling nozzle with at least one opening in the filling port;

dispensing the granular material into the HIP can; and preventing the dispensing granular material into the HIP can prior to aligning the at least one opening of the filling nozzle with the at least one opening in the filling port by configuring the filling port to disallow dispensing of granular material until said aligning is completed, wherein the filling nozzle and the filling port have a concentric, tube-in-tube design and the filling port further comprises a valve that is configured to provide an evacuation path, the evacuation path safely mitigating dust contamination from the granular material.

2. The method of claim 1, further including:

providing the filling port as a single fill port proximate a lid of the HIP can, and wherein the dispensing granular material into the container is performed by providing the granular material to the single fill port proximate the lid of the HIP can.

3. The method of claim 1, wherein the dispensing granular material into the container is further performed such that granular material is provided to the HIP can through the internal tube of the concentric tube-in-tube design; and evacuating the HIP can volume by pulling granular material through the concentric external tube of the concentric tube-in-tube design via a vacuum.

4. The method of claim 1, wherein the granular material is radioactive or toxic.

5. A system for dispensing granular material into a container configured to be hot isostatically pressed, the system comprising a filling nozzle having at least one opening, the filling nozzle being configured to open and close via rotary actuation, a filling port that is integrally connected to the container and containing an opening for receiving granular material, wherein the filling nozzle and filling port are configured to selectively attach together, wherein the filling nozzle is configured to conditionally allow the granular material to be dispensed into the container when an opening of the filling nozzle is aligned with the opening in the filling port, further wherein the filling portion comprises a single filling port located on an end of the container, wherein the filling nozzle and the filling port have a concentric, tube-in-tube design and the filling port further comprises a valve that is configured to provide an evacuation path, the evacuation path safely mitigating dust contamination from the granular material.

6. The system of claim 5, wherein the container further comprises a lid, the lid having a symmetrical design configured to enable centralized filling via the single filling port.

7. The system of claim 5, further comprising one or more safety locks configured to conditionally allow a filling process to begin when the filling nozzle and container are securely fastened together.

8. The system of claim 7, wherein the one or more safety locks comprises a push-open or rotary-open coupling that is configured to ensure valves are open only when the filling nozzle and container are intimately engaged.

9. The system of claim 7, wherein the filling port is spring-loaded and configured to rest in a closed position.

10. The system of claim 5, further comprising at least one vacuum attached to an end thereof, the vacuum being configured to allow the simultaneous filling of radioactive granular and evacuation of the container configured to be hot isostatically pressed.

11. The system of claim 5, further comprising a vibratory device or vacuum powder compaction device that is configured to pack the granular material and thereby increase its density.

12. The system of claim 11, further comprising one or more sintered filters that is in line with an evacuation pathway, the one or more sintered filters being further configured to prevent dust carryover.

13. The system of claim 5, wherein the filling nozzle is a remote interchangeable filling nozzle that enables remote maintenance of the container and access to an inside area of a hot cell.

14. The system of claim 5, further comprising at least one in-line rotary valve configured to control a mass flow of granular material.

15. The system of claim 14, wherein each respective one of the at least one in-line rotary valves includes faces made of ceramic with polished surfaces, thereby ensuring leak tight sealing and the prevention of damaging abrasion of the faces.

16. The system of claim 5, further comprising a pre-fill hopper connected to the nozzle to prevent overfilling of the container.

17. The system of claim 5, wherein the at least one opening comprises a tre-foil configuration in which the rotary actuation opens by rotating about 60 degrees.

18. The system of claim 5, wherein the at least one opening of the filling nozzle is configured to align with the opening in the filling port via set pins, the set pins projecting from the filling nozzle and being restrainedly circumscribed by openings on the filling port when engaged therewith.

* * * * *